US005316156A

United States Patent [19]

Land et al.

[11] Patent Number: 5,316,156

[45] Date of Patent: May 31, 1994

[54] DISPLAY RACK

[76] Inventors: Marty W. Land, 211 White Oak St., Tullahoma, Tenn. 37388; Russell E. Mangrum, 48 Broadrick Rd., Normandy, Tenn. 37360; Joseph W. Martin, Rte. 2, Box 152D, Wartrace, Tenn. 37183

[21] Appl. No.: 242

[22] Filed: Jan. 4, 1993

[51] Int. Cl.[5] ..... A47F 5/00

[52] U.S. Cl. ..... 211/149; 211/132; 211/72; 211/50

[58] Field of Search ..... 211/132, 149, 130, 72, 211/55, 50; 248/174

[56] References Cited

U.S. PATENT DOCUMENTS

| | | | |
|---|---|---|---|
| 2,312,594 | 3/1943 | Smith et al. | 211/130 X |
| 3,892,450 | 7/1975 | Kolster et al. | 211/55 X |
| 4,164,287 | 8/1979 | Muller et al. | 211/72 X |
| 5,050,747 | 9/1991 | Krautsack | 211/55 X |
| 5,213,220 | 5/1993 | McBride | 211/149 X |

*Primary Examiner*—Robert W. Gibson, Jr.
*Attorney, Agent, or Firm*—I. C. Waddey, Jr.

[57] ABSTRACT

A display rack having a foundation consisting of a back, top, bottom and sides and a core which can be folded to fit within the foundation creating multiple shelves within the rack. The core is assembled within the rack through the use of ears and slots without the need of screws, snaps, clamps, buttons, or the like to hold the assembled structure together. The shelves of the rack may be separated by a divider which also is assembled within the foundation through the inner connection of the ears provided on the divider fitting into slots cut and formed into the foundation. The sections of the rack which are created by the shelves and divider can be further sub-divided into compartments by the use of wings are formed in the core and are connected to the core by a pivot hinge which allows the wing to swing into the sections of the rack and form compartments. A clear strip extends from one side of the rack to the other across the face of each section and the clear strip has a leaf which extends over the seat of the shelf to hold the material being displayed within the compartments. The clear strips have arms on each ends which wrap about the sides of the display rack and fingers which tuck into openings in the back of the back to secure the clear strip to the rack.

7 Claims, 4 Drawing Sheets

DISPLAY RACK

BACKGROUND OF THE INVENTION

The present invention relates generally to display racks and more particularly to display racks made of corrugate cardboard or similar materials which can be cut into a pre-designed pattern and folded in order to create the unique display rack of the present invention.

It will be appreciated by those skilled in the art that point of sale displays often occur with the use of display racks and that such display racks, when assembled, are bulky and space consuming. The bulk of such display racks and the space required for their use is acceptable once the display rack is assembled and in place at the retail establishment using it. However, getting the display rack to the retail establishment oftentimes requires shipping the display rack through commercial carriers and the like. Extra bulk increases the expense of such shipments and, in addition, if the display rack is shipped in its assembled condition, it oftentimes gets damaged in transition. Such display racks are particularly susceptible to damage when they are made of corrugate cardboard and the like, being rather fragile and subject to being crushed by excess weight being placed upon them.

For the foregoing reasons, it is desirable to have a display rack made of corrugate cardboard or of similar substance which can be shipped in a disassembled condition. Such a rack, in its disassembled condition is preferably shipped as flat packaging without exposing the display rack to the risk of being crushed during transit. To this end, there have been several attempts to design a display rack which can be manufactured through the use of several pieces that can be shipped in a flat condition and when received at the retail facility, folded and assembled to create a useful point of display device. One such attempt is disclosed in U.S. Pat. No. 2,135,093 issued to Abrams in 1938. Abrams device shows a display rack with compartments that can, in turn, be subdivided; but the device, in order to have multiple compartments requires a large number of pieces to be assembled and is therefore time consuming and awkward to put together.

Another feature that is desirable in a point of sale display rack is the ability to show the product being sold, such as greeting cards, packets containing flower seed or garden seed, brochures and pamphlets, etc. through the compartments of the display racks. The U.S. Pat. No. 2,491,652 to Feerick attempts to meet this need by providing a spring across the front of the rack in order to hold the contents of the compartments in place and yet display the contents to the purchasing public. However, the Feerick disclosure has the disadvantage of the open bottom of the compartment which would allow the material displayed in the compartments to slip out of the compartment onto the floor.

The deficiencies of the prior art have left a need for a display rack that is simple to manufacture, easy to assemble, can be shipped in a flat unassembled fashion with a minimum number of pieces, can clearly display the merchandise being offered for sale and which will contain the merchandise in a secure fashion to keep it from falling from the rack.

The display rack can also be shipped assembled at a reduced weight as compared to, and without breakage as experienced with, hard plastic racks.

SUMMARY OF THE INVENTION

A display rack having a foundation consisting of a back, top, bottom and sides and a core which can be folded to fit within the foundation creating multiple shelves within the rack. The core is assembled within the rack through the use of ears and slots without the need of screws, snaps, clamps, buttons, or the like to hold the assembled structure together. The shelves of the rack may be separated by a divider which also is assembled within the foundation through the inner connection of the ears provided on the divider fitting into slots cut and formed into the foundation. The sections of the rack which are created by the shelves and divider can be further sub-divided into compartments by the use of wings which are formed in the core and are connected to the core by a pivot hinge which allows the wing to swing into the sections of the rack and form compartments. A clear strip extends from one side of the rack to the other across the face of each section and the clear strip has a leaf which extends over the seat of the shelf to hold the material being displayed within the compartments. The clear strips have arms on each ends which wrap about the sides of the display rack and fingers which tuck into openings in the back of the rack to secure the clear strip to the rack.

DESCRIPTION OF THE PREFERRED EMBODIMENT

Figure 1:
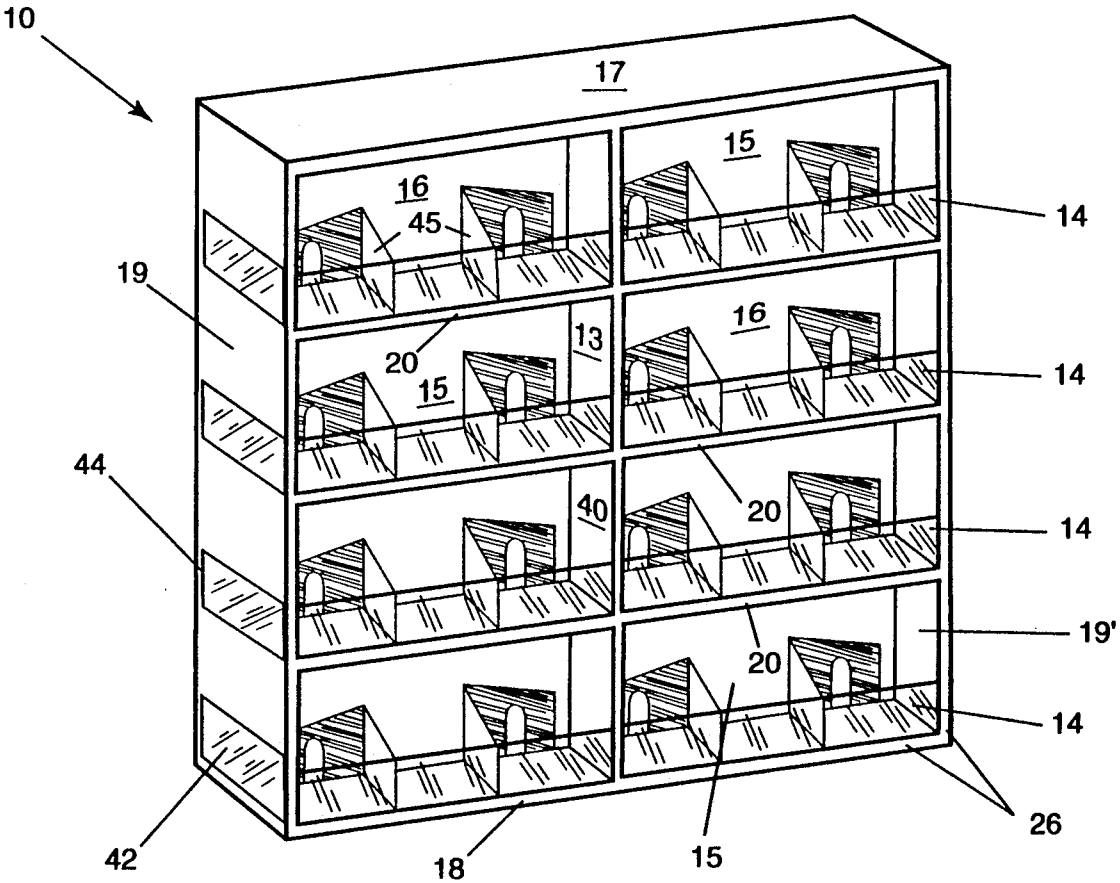
FIG. 1 is a perspective view of the display rack in assembled condition.
Figure 5:
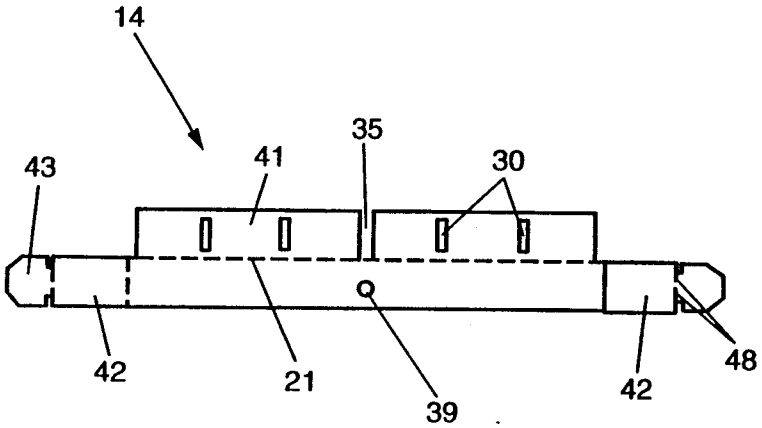
FIG. 5 is a plain view of the strip.

A description of the preferred embodiment of the invention will be best understood when considered in conjunction with the enclosed drawings wherein like numerals consistently refer to like parts throughout the various figures. Referring first to FIG. 1, the display rack of the present invention can be seen in assembled condition. The display rack 10 includes a foundation 11 (FIG. 2), a core 12 (FIG. 3), one or more dividers 13 (FIG. 4) and clear strips 14 (FIG. 5). The foundation 11, core 12 and divider 13 are all constructed preferably of a corrugate cardboard material or some similar material that has the advantages of being light weight, reasonably inexpensive, easy to bend if scored and creased properly yet of sufficient strength and rigidity to hold its shape and bear modest loads without deflection. The clear strip 14 is constructed of a clear flexible material such as a 10 mil. clear PVC.

The foundation 11, core 12, divider 13 and clear strip 14 are all manufactured to a specific pattern from flat stock and are cut, punched, scored and creased in the manner as is more specifically described hereinafter. Thus, the display racks, through the manufacture of their various parts, can be easily manufactured in mass quantities at a substantially reduced expense compared to the prior art devices. There are only four parts to each display rack; namely, the foundation 11, core 12, divider 13 and the clear strips 14. The only other parts that are required for the display rack of the present invention, which parts are optional, are the snaps 40 which connect the clear strips 14 to the divider 13.

Figure 2:
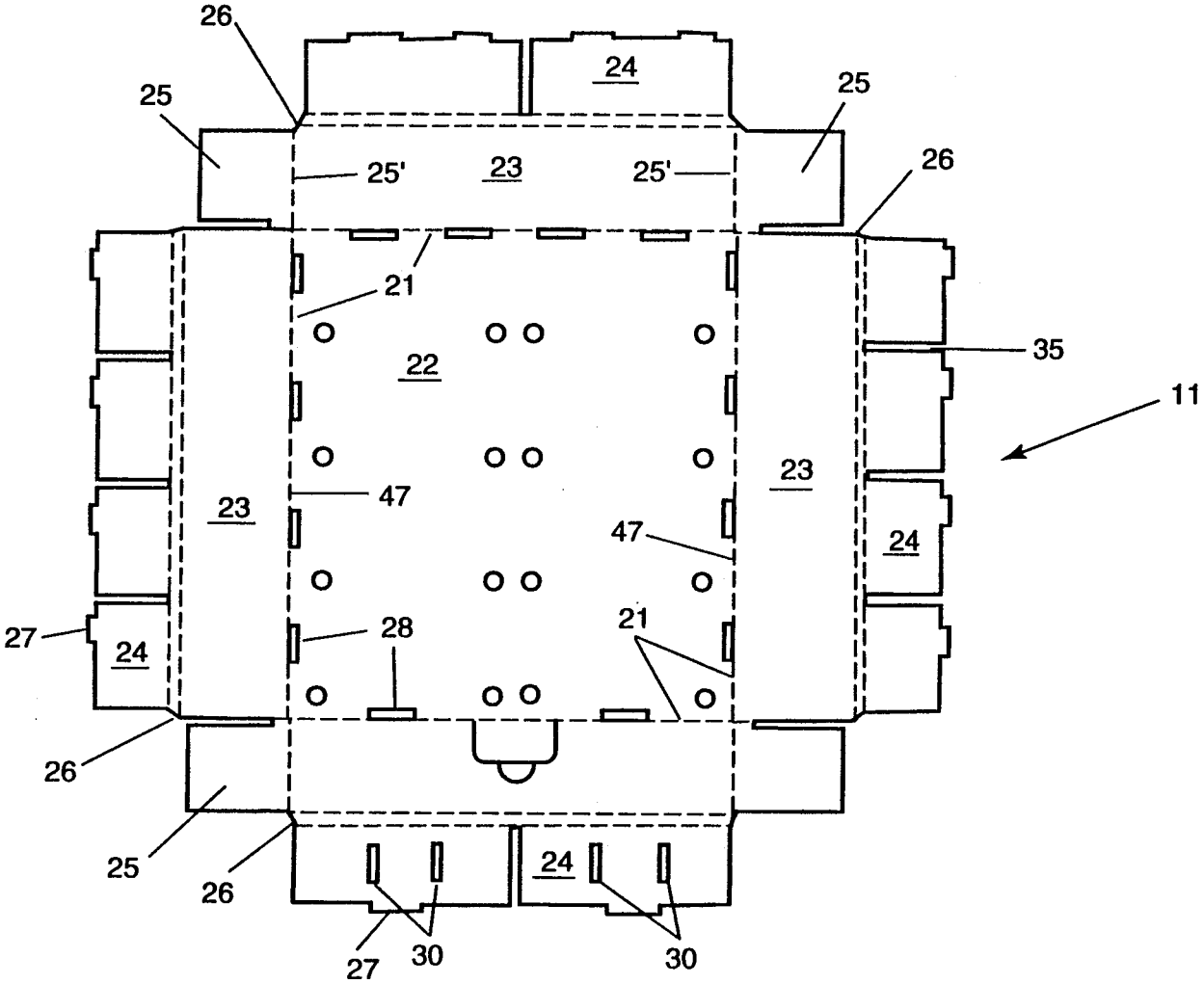
FIG. 2 is a plain view of the foundation before it is folded to create a box for receipt of the core of the display rack.

As can be seen from FIG. 2, the foundation 11 is a flat piece of corrugate cardboard material which has been cut, punched and creased to allow it to be folded into the shape of a box for receipt of the core 12 to form the display rack of the present invention. The foundation 11, once formed into a box, receives the core 12 which sub-divides the box into a number of shelves. As can be seen from FIG. 1, there are three shelves 20, which, along with the bottom 18, gives a total of four shelves in the display rack as is illustrated in the preferred embodiment. It should be understood however that any number of compartments, as hereinafter described, could be created using the teachings of the present invention.

The shelves 20 are sectioned by the divider 13 into a number of sections 16 which in turn are divided into numerous compartments 15 by the wings 45 which are a part of the core 12.

The display rack includes a top 17, bottom 18 and sides 19 and 19'. Referring to FIG. 2, the foundation 11, which is folded to form a box to received a core 12, includes a back 22 and panels which are folded to form the top 17, bottom 18 and sides 19 and 19' respectively. The panels include outside sections 23 and inside sections 24. The outside section 23 is connected to the back 22 by hinge 21. Hinge 21, in the preferred construction is a creased line in the corrugate cardboard stock used to form the foundation 11. The crease may be beveled in a fashion well known in the art so that the panels can be folded along the crease line forming the hinge 21 to a point where the panels extend perpendicularly from the plane of the back 22. Connected to the outside sections 23 are the inside sections 24 by joints 26. Joints 26 are similar to the hinges 21 in that they are creased lines; however, the crease lines forming the joints 26 are wider than the creases forming the hinges 21 in order to allow the rotation of the outside sections 24 about the line of the joints 26 through a rotation of 180° so that the outermost portion of the panels is folded to become the inside section of the box which is created from the foundation 11.

Still referring to FIG. 2, the inside sections 23 of the top 17 and bottom 18 of the foundation include tabs 25 at each end of the outside section 23. When the outside section 23 is folded about hinge 21 to a position perpendicular to the back 22, the tabs 25 are folded about the line 25' into the chamber of the box formed from the foundation. The tabs 25 are then captured within the slot formed when the inside section 24 is folded about the joint 26 into face-to-face engagement with outside section 23 of the sides 19,19', thus holding the top 17 and bottom 18 of the foundation in a fixed relationship to the sides 19 and 19'. The inside sections 24 of the top 17 and bottom 18 of the foundation 11 are then folded about the hinge line 26 into the chamber of the box formed from the foundation 11 to seat against the edges of the inside sections 24 of the sides 19 and 19' as they fit into the box formed from the foundation 11. The inside sections 24 of each of the panels include ears 27 which fit into slots 28 formed parallel to and just inside the line of hinge 21 of the foundation 11.

Figure 3:
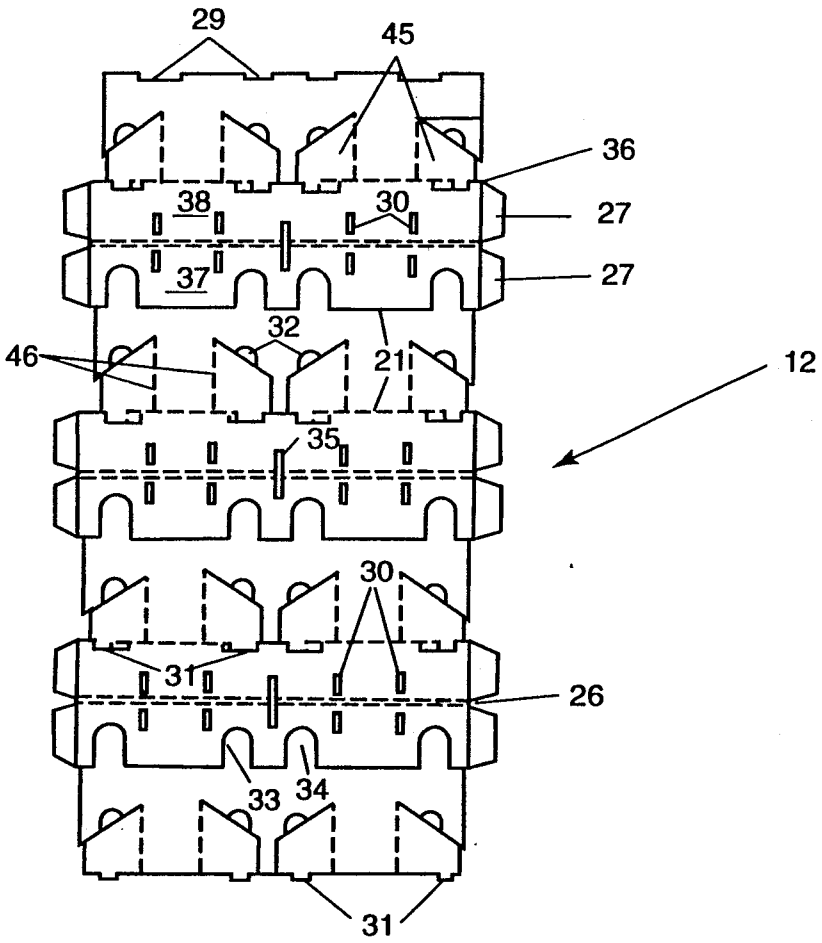
FIG. 3 is a plain view of the core of the display rack before it is folded to fit into the display rack.
Figure 4:
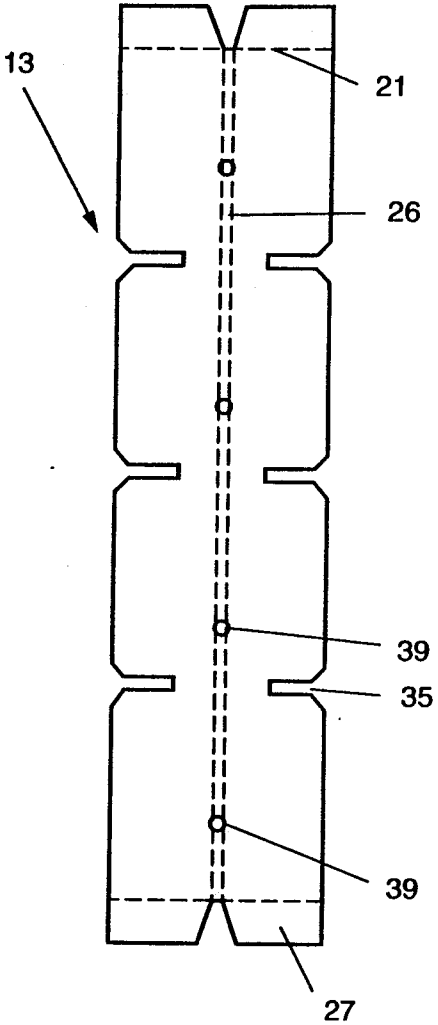
FIG. 4 is a plain view of the divider.

Referring now to FIG. 3, the core is shown in its manufactured shape. The core as shown in FIG. 3 is flat and can be shipped in this condition to be assembled at the retail location where it is to be used.

The core 12 is designed to fit within the box formed from the foundation 11 once the foundation has been folded in the manner described above. The core 12 includes notches 29 which are at a point on the perimeter of the core that coincides with the location of the ears 27 on the top 17 and bottom 18 of the foundation 11 once the outside section 24 of the panels are folded into the chamber of the box formed from the foundation. The notches 29 mate about the ears 27 as the ears 27 fit within the slots 28.

Key holes 30 are formed in the core 12 and are designed to mate with the keys 31 formed in the bottom of the wings 45 once the wings are pivoted about the line of the pivot hinge 46 so that the wings project perpendicular from the plane of the core. At the bottom of the core, the keys 31 fit within key holes 30 cut within the inside section 24 of the bottom 18 of the foundation 11.

Referring to FIG. 3, the core 12 is folded to form an insert for the box of the foundation 11 as follows:

First, there is arcuate cut 33 forming a finger slot 34. The person assembling the display rack can punch the corrugate cardboard of the core 12 at the finger slot 34 to push the fingers created by the arcuate cut 33 through the core 12 when the core 12 is folded along the line of hinge 21. The shelves 20 are then created by pulling the base 37 towards the person assembling the core, folding the core along the joints 26, causing the base 37 and the seat 38 to come into a face-to-face relationship and thereby create a shelf 20 which projects perpendicularly from the plane of the core 12. In this particular example of the preferred embodiment, three shelves 20 are created but any number of shelves can be created by appropriate modification of the core.

Once the shelves 20 are created by folding the core in the manner described above, ears 27 which project from the sides of the core 12 are bent into a plane perpendicular to the plane of the shelf 20 and perpendicular to the plane of the core 12. Once bent along the joint 26 in this fashion, the ears 27 pass through the slit 35 formed radially in the inside section 24 of the panels which form the sides 19 and 19'. The ears 27 are entrapped within the slot formed by the face-to-face relationship between the outside section 23 and the inside section 24 to hold the shelves in place and to stabilize the structure of the display rack 10. During the process of assembling this display rack, the folding over of the inside section 24 of the panels forming the top 17, bottom 18 and the sides 19 and 19' is usually reserved until the core 12 is placed within the box formed by folding the foundation 11. This will enable the sides 19 and 19' to capture the ears 27 and hold the shelves 20 in place.

In order to form sections 16 within the display rack 10, divider 13 can be placed vertically within the chamber of the display rack. Divider 13 has a joint 26 so that the divider may be folded along the line of the joint 26 to place the two sides of the divider in face-to-face relationship. Slits 35 are cut radially in the divider 13 in a face-to-face relationship approximately half the depth of the divider. Ears 27 are at each end of the divider and the ears are folded along the line of hinge 21 to a point where the plane of the ears 27 is perpendicular to the plane of the divider 13. The ears 27 fit through the slit 35 formed in the inside section 24 of the top 17 and bottom 18 of the foundation 11 to hold the divider in place when the outside section 24 is folded about the joint 26 into a face-to-face relationship with the outside section 23. The slits 35 in the divider mate with the slits 35 that are formed in the shelves 20 to hold the shelves and the divider in a stable, fixed relationship. The divider 13 also has snap holes 39 which are provided to receive snaps 40. Snaps 40 pass through the snap holes 39 in the clear strip 14 and the snap hole 39 in the divider to hold the clear strip in a fixed relationship to the divider.

Referring now to FIG. 5, the clear strip 14 is shown. The clear strip 14 has a leaf 41 which folds along the line created by the hinge 21 so that when assembled, the clear strip has a leaf 41 that overlies the seat 38 of the shelf 20. A slit 35 is cut in the leaf 41 to fit around the divider 13 and hold the clear strip in a fixed relationship to the divider. The leaf 41 has key holes 30 which are placed to mate with the key holes 30 in the shelves 20 and are designed to receive the keys 31 formed in the bottom of the wings 45.

Once the leaf wing 41 is folded along the line created by the hinge 21, the plane of the leaf wing 41 is perpendicular to the plane of the clear strip 14; thus, the clear strip 14 passes along the front of the compartments 15 forming a plastic clear strip guardrail on the front of the display rack to keep the materials being displayed in the compartments from falling from the rack.

The clear strip 14 has arms 42 at each end thereof which fold perpendicular to the clear strip 14 along the line of the hinge 21' so that the arm 42 goes around the outside of the sides 19 and 19'. The fingers 43 at the end of the arms 42 tuck into glove slots 44 cut into each side of the foundation 11 at cut 47. The glove slots 44 will normally be the approximate width of the neck 48 created by cutting the edges of the clear strips where the fingers connect to the arms. This arrangement allows the fingers 43 to fit within the cut 47 but the shoulders formed by the difference between the width of the neck 48 and the width of the fingers 43 secures the clear strip 14 to the display rack 10.

After the clear strips 14 have been assembled onto the display rack, snaps 40 (FIG. 1) are pushed through the openings 39 in the clear strips 14 and the divider 13 to securely snap the clear strip to the display rack and hold it in a fixed relationship thereto.

The final step of assembly of the display rack is to reach into the holes 32 cut within the core 12 and pull the wings out from the core to a point where the plane of the wings 45 extend perpendicular to the plane of the core 12, the wings bending along the pivot hinge 46 to create multiple compartments 15 within sections 16 of the display rack. The keys 31 at the bottom of the wings 45 fit within the key holes 30 formed in the shelves 20 to secure and the wings into place and fix them in a relationship to the remaining structure.

Although there have been described particular embodiments of the present invention of a new and useful display rack, it is not intended that such references be construed as limitations upon the scope of this invention except as set forth in the following claims.

What we claim is:

1. A display rack including a foundation, a core and one or more dividers constructed from a cardboard-like material and a clear strip constructed from a plastic-like material, wherein:

a. the foundation, core, dividers and strips are formed from plane sheets of material in pre-determined patterns;

b. the foundation includes a back and panels, the panels connected to the back by hinges;

c. the panels include sections which can be folded upon themselves to create a top, bottom and sides so that when the foundation is assembled it takes the shape of a box;

d. the core includes joints which allows the core to be folded upon itself to form one or more shelves, the core having ears which are captured within slots formed in the panels that are folded to create the sides to the foundation, and the ears fit within the slots to hold the shelves in place within the box formed by folding the foundation;

e. a divider which extends perpendicular to the shelves and which has slots that mate with the shelves to connect the shelves and the divider in a fixed relationship;

f. the divider having ears which fit within slots formed within the panels of the foundation which are folded to form the top and bottom of the box created when the foundation is folded to assemble the display rack; and g. clear strips in contact with the shelves and aligned with the shelves to create a barrier across the open part of the sections formed when the core is inserted in the foundation, said strips passing around the sides of the foundation and connecting to the foundation.

2. The display rack as defined in claim 1 wherein wings are formed in the core and are attached thereto by pivot hinges so that the wings may be rotated to a position perpendicular to the plane of the core and form compartments within the display rack.

3. The display rack as defined in claim 1 wherein each clear strip has a leaf which is at an angle perpendicular to the plane of the clear strip so that each leaf overlies the shelf adjacent to said leaf.

4. The display rack as defined in claim 1 wherein snap holes are formed in the clear strips and the divider and the clear strips are connected to the divider by a snap passing through the snap holes.

5. The display rack as defined in claim 1 including cuts formed in the back of the foundation and wherein the clear strips have arms which wrap around the sides of the foundation and fingers connected to the ends of the arms which fingers fit within said cuts.

6. The display rack as defined in claim 2 wherein the wings have keys and the shelves have key holes and the keys fit within the key holes when the wings are rotated about their pivot hinges to form compartments within the display rack.

7. The display rack as defined in claim 5 wherein the strips have necks between the arms and the fingers which necks are approximately the same width as the cuts in the foundation and the necks form shoulders which are wider than the necks in order to capture the fingers within the cuts of the foundation.

* * * * *